United States Patent [19]

Heck

[11] 4,302,482

[45] Nov. 24, 1981

[54] PROCESS FOR APPLYING METALLIC SPRAYED COATS TO THE INNER SURFACE OF A HOLLOW BODY

[75] Inventor: Klaus Heck, Ingolstadt, Fed. Rep. of Germany

[73] Assignee: Audi NSU Auto Union Aktiengesellschaft, Fed. Rep. of Germany

[21] Appl. No.: 140,003

[22] Filed: Apr. 14, 1980

Related U.S. Application Data

[63] Continuation of Ser. No. 940,838, Sep. 8, 1978, abandoned.

[30] Foreign Application Priority Data

Sep. 1, 1977 [DE] Fed. Rep. of Germany ..... 2739356

[51] Int. Cl.[3] ..... B05D 1/08

[52] U.S. Cl. ..... 427/34; 427/239; 427/236; 427/42 Z

[58] Field of Search ..... 427/236, 319, 398, 422, 427/34, 239

[56] References Cited

U.S. PATENT DOCUMENTS 2,588,422 12/1947 Shepard ..... 427/239

3,839,618 10/1974 Muehlberger ..... 219/121 P

OTHER PUBLICATIONS

Metal Progress, pp. 142, 144, 146, 148.

Ceramic Age 1/1969 pp. 40–42.

*Primary Examiner*—Sam Silverberg

*Attorney, Agent, or Firm*—Kane, Dalsimer, Kane, Sullivan and Kurucz

[57] ABSTRACT

A process for applying a metallic sprayed coat to the inner surface of a metal hollow body includes heating the body to a temperature of over 150° C. before coating and cooling the body through at least 50° C. during the coating process. Positive shrinkage tensions are thereby created during the coating which act to improve adhesion in operation.

5 Claims, 2 Drawing Figures

Figure 1:
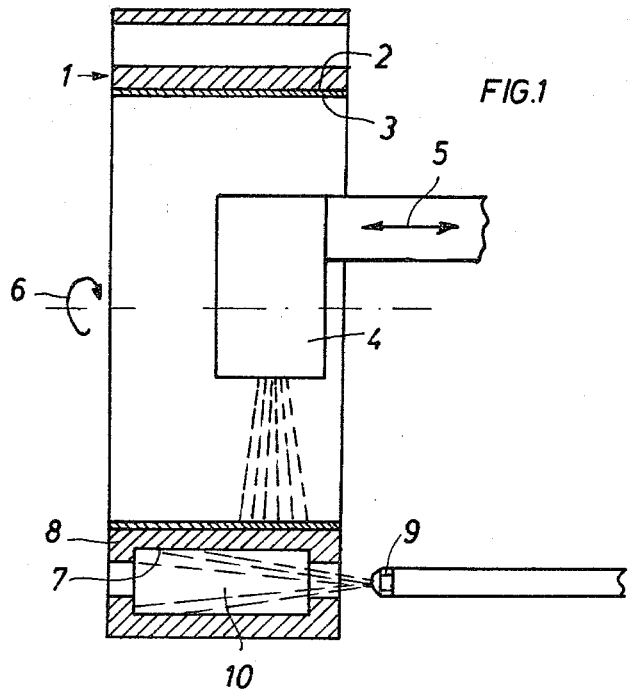

PROCESS FOR APPLYING METALLIC SPRAYED COATS TO THE INNER SURFACE OF A HOLLOW BODY

This is a continuation of application Ser. No. 940,838, filed Sept. 8, 1978, now abandoned.

BACKGROUND OF THE INVENTION

The invention relates to a process for applying metallic sprayed coats by means of a thermal spraying process to the inner surface of a hollow body, the body being composed of a metal having a higher heat expansion coefficient than that of the coating material.

Considerable difficulties arise with regard to adhesion of the sprayed coat, which are caused by the variable heat expansion coefficient of the base material and the sprayed coat, especially when thicker sprayed coats (more than 0.3 mm) have to be applied by thermal spraying processes, such as plasma spraying, oxyacetylene or arc spraying processes. In addition to this, an increase of the separating destructive load in the adhesion surface occurs as a result of the inherent shrinkage of the coat which is applied in layers. The shrinkage tensions increase with the thickness of the sprayed coat and the coating speed, not only as a result of the summed up partial shrinkage of the sprayed layers, but also as a result of the increasing inherent strength of the coat, which thereby loads the undercoat with its own adhesion capacity and finally exceeds it.

An attempt has already been made to reduce the heat and shrinkage tensions occurring during spraying in hollow bodies by maintaining the hollow body at a certain temperature, i.e. to prevent an expansion of the hollow body which might lead to dislodging of the coat during coating. This measure does not, however, prevent a reduction of the adhesion of the sprayed coat in the case of coated hollow bodies which, in operation are exposed to very strong heating, such as, for example, cylinders of internal combustion engines.

It is the aim of the present invention to improve the adhesion of metallic sprayed coats which are applied thermally to the inner surfaces of hollow bodies.

According to the present invention there is provided a process for applying a metallic sprayed coat, by means of a thermal spraying process, to the inner surface of a hollow body which is composed of a metal having a heat expansion coefficient which is larger than that of the coating metal, in which the hollow body is heated to a temperature of over 150° C. before coating and is cooled by at least 50° C. during coating.

As a result of the process according to the invention, positive shrinkage tensions are created during the coating operation which continue to exist even during thermal loading of the hollow body and act to improve adhesion in operation.

Heat loss from the hollow body is preferably progressively increased in accordance with the increase in the thickness of the coat. This progressive cooling induces the existence of pressure shrinkage tensions during coating, which increases as the coat thickness increases, and cause the hollow body to embrace the sprayed coat with increasing force.

Cooling is advantageously carried out by evaporation of a fluid cooling medium, for example, water, on the outer surface of the wall of the hollow body.

The process according to the invention is primarily intended for spraying alloyed or non-alloyed steel or ferrotitanium onto the inner surfaces of hollow bodies of aluminum and aluminum alloys, but it can also be used, for example, for spraying carbide or oxide coats, for instance zircon oxide, onto the inner surfaces of steel hollow bodies.

IN THE DRAWINGS

Figure 2:
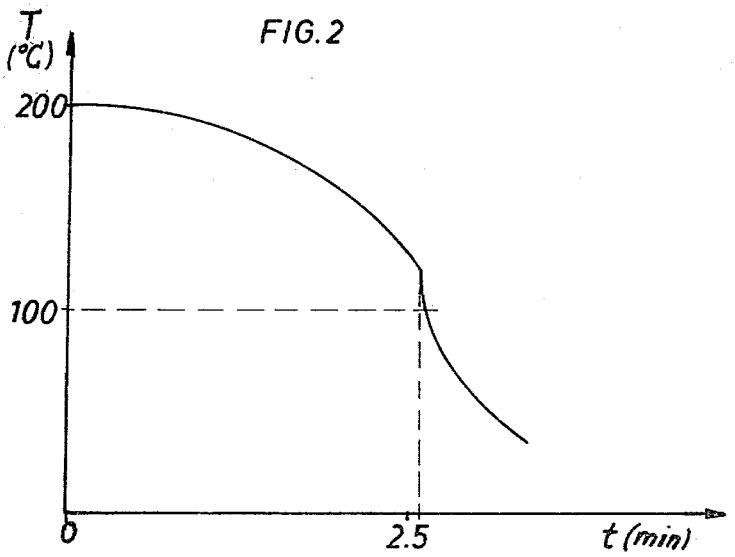

The invention may be performed in various ways, and a specific embodiment is now described by way of example with reference to the accompanying drawings, in which:

FIG. 1 is a diagrammatic view of a device for carrying out the process according to the invention; and FIG. 2 is a temperature against time graph showing the cooling of the hollow body during the spraying operation.

BRIEF DESCRIPTION OF THE PREFERRED EMBODIMENT

Referring to FIG. 1, a hollow cylinder or jacket 1 of an internal combustion engine is made of an aluminum alloy, and its inner surface 2 is coated with a sprayed coat 3 of steel. A plasma spraying appliance 4, which during coating is moved to and fro over the width of the cylinder or jacket 1 as shown by the double arrow 5, serves for coating. The cylinder or jacket 1 is simultaneously rotated, as illustrated by the arrow 6.

Before coating, the cylinder or jacket 1 is heated to 200° C. in a heating furnace. This temperature lies within the range of the working temperature of the cylinder or jacket. During coating, the wall 8 of the cylinder or jacket 1 is cooled by evaporating a fluid cooling medium on the outer surface 7 of the wall 8. The cooling agent is preferably water, which is sprayed together with air through a jet 9 into a hollow space 10 in the wall 8. Cooling is progressively increased by an enlargement of the quantity of cooling fluid in accordance with the increase in the thickness of the sprayed coat, so that during the spraying operation, cooling of the cylinder or jacket 1 to approximately 120° C. takes place. A plot of the temperature against time is represented in FIG. 2. Shrinkage tensions are thereby created, which similarly increase with increasing coat thickness over-proportionally, whereby a firm embracing of the sprayed coat by the material of the cylinder or jacket 1 is achieved. As a result, working at high application speeds, for example, 0.5 mm/min. is possible.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. In a process for applying a metallic sprayed coat by means of a thermal spraying process to the inner surface of a hollow body which is composed of a metal having a heat expansion coefficient which is larger than that of the coating metal, the improvement in which the hollow body is heated to a temperature of over 150° C. before coating and is cooled by at least 50° C. during coating whereby adhesion of the coat to the inner surface of the hollow body is improved as a result of positive shrinkage tension created during the coating operation which tension continues to exist during subsequent thermal loading caused by operation of the hollow body.

2. A process as claimed in claim 1, in which removal of heat from the hollow body is progressively increased in accordance with the increase in the thickness of the coat.

3. A process as claimed in claim 1, in which cooling is carried out by evaporating a fluid cooling medium on the outer surface of the wall of the hollow body.

4. A process as claimed in claim 3 in which the fluid cooling medium is water.

5. In a process for applying a metallic sprayed coat by means of a thermal spraying process to the inner surface of a hollow body, which is composed of a metal having a heat expansion coefficient which is larger than that of the coating metal, the improvement in which the hollow body is heated to a temperature of over 150° C. before coating and is cooled by at least 50° C. during coating, with said cooling being carried out by evaporating a fluid coating medium on the outer surface of the hollow body and the removal of heat from said body being progressively increased relative to the increase in the thickness of the coat being applied whereby adhesion of the coat to the inner surface of the hollow body is improved as a result of positive shrinkage tension created during the coating operation which tension continues to exist during subsequent thermal loading caused by operation of the hollow body and which positive pressure shrinkage tensions during coating increases as the coat thickness increases causing the hollow body to embrace the sprayed coat with increasing force.

* * * * *